US009506278B2

(12) United States Patent
Mattrisch

(10) Patent No.: US 9,506,278 B2
(45) Date of Patent: Nov. 29, 2016

(54) MODULAR MULTI-POINT LOCK SYSTEM

(75) Inventor: Daniel D. Mattrisch, Fort Atkinson, WI (US)

(73) Assignee: HOPPE Holding AG, Müstair (CH)

( * ) Notice: Subject to any disclaimer, the term of this patent is extended or adjusted under 35 U.S.C. 154(b) by 308 days.

(21) Appl. No.: 13/429,950

(22) Filed: Mar. 26, 2012

(65) Prior Publication Data

US 2012/0248789 A1 Oct. 4, 2012

Related U.S. Application Data

(60) Provisional application No. 61/469,559, filed on Mar. 30, 2011.

(51) Int. Cl.
*E05B 59/00* (2006.01)
*E05C 9/20* (2006.01)

(52) U.S. Cl.
CPC ..... *E05C 9/20* (2013.01); *Y10T 29/49826* (2015.01); *Y10T 292/0836* (2015.04)

(58) Field of Classification Search
CPC ..... E05C 9/20; Y10T 29/49826; Y10T 292/0836
See application file for complete search history.

(56) References Cited

U.S. PATENT DOCUMENTS 1,338,713 A * 5/1920 Toney ..... 292/335
4,362,328 A * 12/1982 Tacheny et al. ..... 292/36
4,639,021 A * 1/1987 Hope ..... 292/7
5,171,047 A * 12/1992 Korb et al. ..... 292/39
5,290,077 A * 3/1994 Fleming ..... 292/35
5,350,207 A * 9/1994 Sanders ..... 292/335
5,524,941 A * 6/1996 Fleming ..... 292/34
5,603,534 A * 2/1997 Fuller ..... 292/2
5,782,114 A 7/1998 Zeus et al.
6,209,931 B1 4/2001 Von Stoutenborough et al.
6,217,087 B1 * 4/2001 Fuller ..... 292/39
6,273,480 B1 * 8/2001 Burton ..... 292/340
7,707,862 B2 * 5/2010 Walls et al. ..... 70/107
7,735,882 B2 * 6/2010 Abdollahzadeh et al. ..... 292/44
2009/0295173 A1 * 12/2009 Heid ..... 292/139
2012/0286525 A1 * 11/2012 Kordowski et al. ..... 292/340

* cited by examiner

*Primary Examiner* — Kristina Fulton
*Assistant Examiner* — Thomas Neubauer
(74) *Attorney, Agent, or Firm* — Reinhart Boerner Van Deuren P.C.

(57) ABSTRACT

A modular multi-point lock system that is both simple to install and easy to service. By inserting the lock case into a recess for containing the lock case that is located in the edge of the door, the shootbolt drive mechanism located within the lock case will engage first and second shootbolts respectively installed into recesses in the top and bottom of the door that communicate with the recess for containing the lock case, without requiring a manual interconnection to be made between the lock case and shootbolts. Similarly, the lock case can be removed from the door without removing the first and second shootbolts.

17 Claims, 4 Drawing Sheets

MODULAR MULTI-POINT LOCK SYSTEM

CROSS-REFERENCE TO RELATED PATENT APPLICATIONS

This patent application claims the benefit of Provisional Application No. 61/469,559, filed Mar. 30, 2011, the disclosure and teachings of that application are incorporated herein in its entirety by this reference.

BACKGROUND OF THE INVENTION

Field of the Invention

The present invention relates generally to multi-point locks, and more particularly to a modular multi-point lock system that is both simple to install and easy to service.

Simple locks have a mortise unit mounted adjacent the edge of a door with a latch and, optionally, a deadbolt that extend from the mortise unit into a latch plate mounted in the door frame into which the door is installed. An increased level of security is afforded by multi-point door locks to provide more secure closure and locking. Typical conventional multi-point door locks have more than one latch or bolt that engages the door frame. Multiple bolts are substantially more difficult to overcome in a forcible entry than a single deadbolt and latch.

For example, instead of the conventional single latch and deadbolt extending from the mortise unit, three bolts and a latch may be used. A first deadbolt and latch engage with the door frame (or with a second door that is locked into the closed position. A second bolt and a third bolt are respectively mounted at the top and bottom edges of the door above and below the mortise unit respectively to engage the upper and lower portions of the door frame, respectively. The second and third bolts, referred to as shootbolts, are also controlled by the mortise unit, and may operate simultaneously with the deadbolt extending from the mortise unit. Examples of such multi-point locks may be found, for example, in U.S. Pat. No. 5,782,114, to Zeus et al., and in U.S. Pat. No. 6,209,931, to Von Stoutenborough at al., both of which are hereby incorporated herein.

Existing multipoint locks are typically complex and have multiple components that are required to install the shootbolts at the top and bottom edges of the door. Further, once installed, such conventional multi-point locks typically require the removal of the door in order to remove the lock from the door. It will be appreciated that such conventional multi-point locks require substantial effort to install them into a door, as well as to remove them from the door for servicing.

It is thus desirable to provide a multipoint lock that is of simple modular construction to make it simple to install the multipoint lock into a door. It is also desirable to make the removal of the lock case of the multipoint lock easy to perform without requiring the removal of the shootbolts from the door.

SUMMARY OF THE INVENTION

The disadvantages and limitations of the background art discussed above are overcome by the present invention. With this invention, three modular assemblies are provided for installation into a door that is appropriately prepared, with the three modular assemblies resulting in a minimal number of installation steps being required to install the modular multipoint lock system of the present invention into a door and thereby providing for a fast, efficient installation.

The first and second assemblies are shootbolt assemblies that may be respectively installed into the top and bottom halves of the door. Each of these shootbolt assemblies have a proximal engagement end that will be located in a recess located in the side of the door into which the lock case may be installed.

When the lock case is installed into this recess, drive arms extending from the lock case will be brought into respective driving engagement with the respective proximal engagement ends of the shootbolt assemblies merely by the act of inserting the lock case into this recess. The modular construction facilitates a non-handed design with handing that can be changed when the lock case is installed into a door.

The lock case may subsequently be removed from this recess, with the drive arms being disengaged from the proximal engagement ends of the shootbolt assemblies merely by the act of removing the lock case from this recess. The lock case can thus be serviced without requiring that the door be removed from its frame. The modular multipoint lock system of the present invention is also compatible with existing door style and trim offerings.

There is also provided a method for installing a modular multi-point locking system in a door or window without the use of manual interconnections such as tools or fasteners. The method includes installing a lock case, a first shootbolt assembly, and a second shootbolt assembly into several recesses defined in a door. The lock case is inserted into a recess defined in the door edge. A first shootbolt assembly which includes an engagement end housing and a driverail coupled to a shootbolt housing and shootbolt is installed into an upper recess of the door that is in communication with the lock case recess.

A second shootbolt assembly which also includes an engagement end housing and a driverail coupled to a second shootbolt housing and shootbolt are installed in a bottom recess which is in communication with the lock case recess.

The engagement end housing of each of the first and second shootbolt assemblies define a slot which is configured to engage a flange which is a part of the lock case. The lock case includes an upper flange and a lower flange, each of which are coupled to a drive arm of the lock case. Each of the flanges engages each of the slots in the respective engagement end housings of the first and second shootbolt assemblies which drivingly couples each of the shootbolt assemblies to the lock case.

The combination of the slot and flange remains in engagement during the operation of the lock case to extend and retract the respective shootbolts in each of the first and second shootbolt assemblies. The installation and extraction of one or both of the shootbolt assemblies from the door can be accomplished without the use of tools or fasteners at the lock case. It should be understood that fasteners, such as wood screws can be used to secure the lock case, and each of the shootbolt housings to the door but that a tool or fastener is not needed to couple or decouple each of the shootbolts to or from the lock case.

The modular multi-point lock system of the present disclosure is of a construction which is both durable and long lasting, and which will require little or no maintenance to be provided by the user throughout its operating lifetime. The modular multi-point lock system of the present disclosure is also of inexpensive construction to enhance its market appeal and to thereby afford it the broadest possible market. Finally, all of the aforesaid advantages and objectives are achieved by the modular multi-point lock system of the present disclosure without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
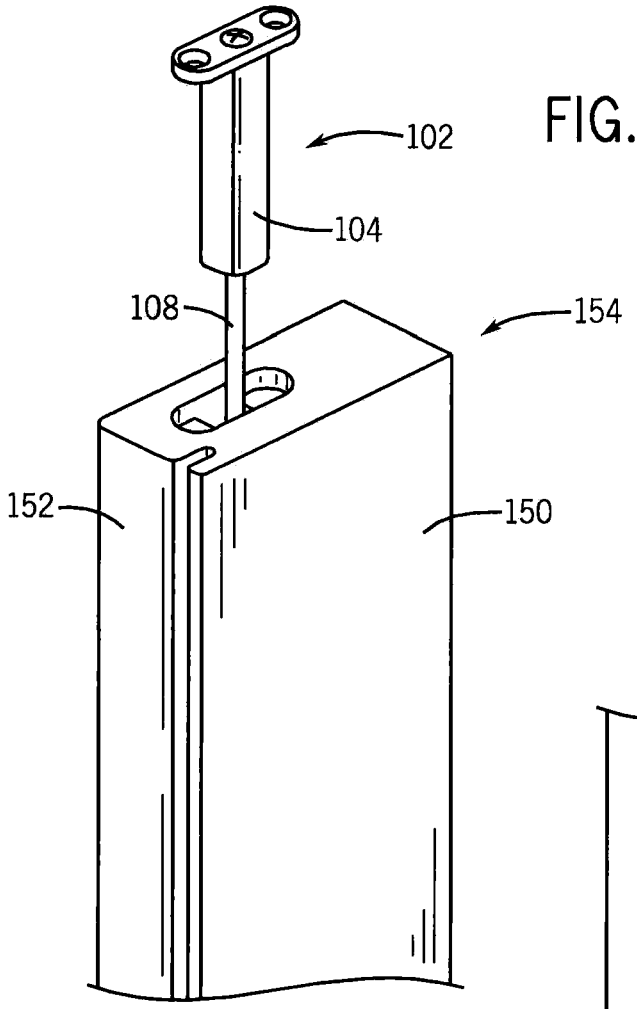
FIG. 1 is an isometric view illustrating the installation of a first shootbolt into the top of a door near an edge thereof.

Referring to FIGS. 1-9, the preferred embodiment of the modular multipoint lock system 100 of the present disclosure has three primary components: a first shootbolt assembly 102 that will be installed in the upper portion 154 of a door 150 adjacent an edge of the door 152, a second shootbolt assembly 120 that will be installed in the lower portion 156 of the door 150 adjacent the edge of the door 152, and a lock case 138 that will be installed in the edge 152 of the door 150. The door 150 is prepared as a recess 158 for containing the lock case 138 into the side of the door is conventional, typically by machining, and then machining in a recess 160 from the top of the door 150 to the recess 158 for the lock case 138 for containing the first shootbolt assembly 102, and then machining in a recess 162 from the bottom of the door 150 to the recess 158 for the lock case 138 for containing the second shootbolt assembly 120.

The first shootbolt assembly 102 consists of a single housing 104 that may be mounted in the top half 154 of a door 150 by inserting it into the recess 160 extending from the top of the door 150 to the lock case 138. The first shootbolt assembly 102 has a proximal engagement end housing 114 at its proximal end 110 that will be located at the top end of the recess 158 for containing the lock case 138 when the first shootbolt 106 is installed into the top half of the door 150. The first shootbolt assembly has a shootbolt housing 104 and a shootbolt 106 located at its distal end 112, both of which will be installed at the top of the door 150 near the edge in a fully recessed fashion using appropriate hardware (typically one or more wood screws). The proximal engagement end housing 114 of the first shootbolt assembly 102 is drivingly connected to the shootbolt 106 at the distal end 112 of the first shootbolt assembly 102 with a first driverail 108, and reciprocal motion of the proximal engagement end housing 114 of the first shootbolt assembly 102 will thereby extend and retract the shootbolt 106 at the distal end 112 of the first shootbolt assembly 102.

The second shootbolt assembly 120 consists of a single assembly that may be mounted in the bottom half 156 of a door 150 by inserting it into the recess 162 extending from the bottom of the door 150 to the lock case 138. The second shootbolt assembly 120 has a proximal engagement end housing 132 at its proximal end 128 that will be located at the bottom end of the recess 158 for containing the lock case 138 when the second shootbolt assembly 120 is installed into the bottom half 156 of the door 150. The second shootbolt assembly 120 has a shootbolt housing 122 and a shootbolt 124 located at its distal end 130, both of which will be installed at the bottom 156 of the door 150 near the edge in a fully recessed fashion using appropriate hardware (typically one or more wood screws). The proximal engagement end housing 132 of the second shootbolt assembly 120 is drivingly connected to the shootbolt 124 at the distal end 130 of the second shootbolt assembly with a second driverail 126, and reciprocal motion of the proximal engagement end housing 132 of the second shootbolt assembly 120 will thereby extend and retract the shootbolt 124 at the distal end 130 of the second shootbolt assembly 120.

Each driverail 108,126 includes a thread portion configured to threadingly engage a threaded portion 116 of each engagement end housing 114,132. In another embodiment, a driverail and engagement end housing are formed as an integral single unit.

Optionally, the first and second shootbolt assemblies 102,120 may be identical in construction.

Referring now to FIG. 1, the installation of the first shootbolt assembly 102 into the top half 154 of the door 150 is schematically illustrated. Following this installation, the hardware (wood screws) will be used to retain the first shootbolt assembly 102 in the top half of the door 150. The fastener typically secures the shootbolt housing 104 to the door 150.

Figure 2:
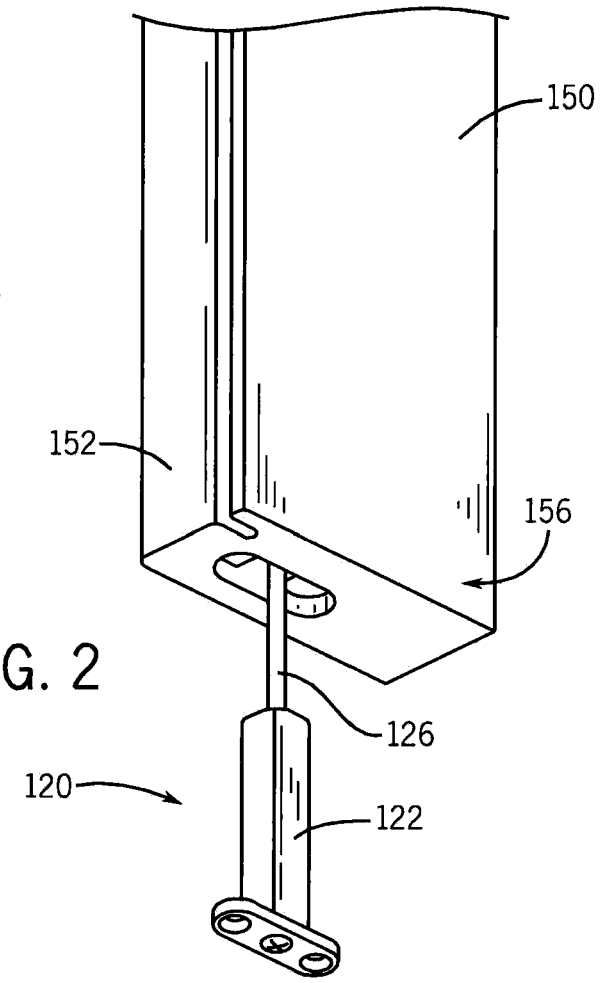
FIG. 2 is an isometric view illustrating the installation of a second shootbolt into the bottom of the door near the edge thereof.

Referring next to FIG. 2, the installation of the second shootbolt assembly 120 into the bottom half 156 of the door 150 is schematically illustrated. Following this installation, the hardware (wood screws) will be used to retain the second shootbolt assembly 120 in the bottom half of the door 150. The fasteners typically secures the shootbolt housing 122 to the door 150.

It will be appreciated by those skilled in the art that the proximal engagement end housings 114,132 of the first and second shootbolt assemblies 102,120 are exposed within the recess 158 for containing the lock case 138. Thus, referring to FIG. 3, when the lock case 138 is inserted into the recess 158 for containing the lock case 138, the drive arms 144 of the lock case 138 will be inserted into engagement with slots 118 in each of the proximal engagement end housings 114,132 of the first and second shootbolt assemblies 102, 120. Thus, a flange 140 of the drive arm 144 located at the top of the lock case 138 will engage the proximal engagement end housing 114 of the first shootbolt assembly 102 (as best shown in the enlarged section shown in FIG. 4), and a flange 142 of the drive arm 144 located at the bottom of the lock case 138 will engage the proximal engagement end housing 132 of the second shootbolt assembly 120 as the lock case 138 is inserted into the recess 158 for containing the lock case 138. The lock case 138 is retained in position within the recess for containing the lock case 138 by hardware (wood screws).

Thus, merely by inserting the lock case 138 into the recess 158 for containing the lock case 138 in the edge of the door 152, the shootbolt drive mechanism (not shown herein) located within the lock case 138 will be brought into driving engagement with the first and second shootbolt assemblies 102,120, without requiring a manual interconnection to be made between the lock case 138 and shootbolt assemblies 102,120. Similarly, it will be appreciated that the lock case 138 can be removed from the door 150 without removing the first and second shootbolt assemblies 102,120.

Figure 5:
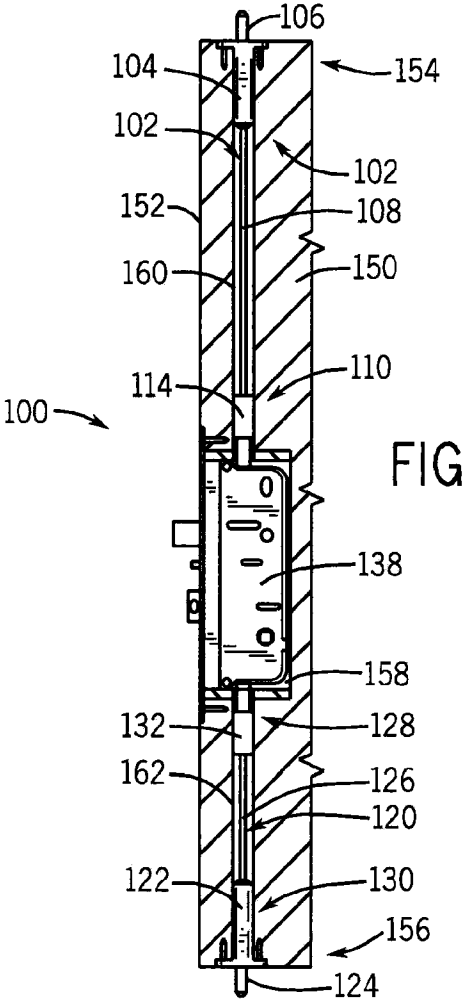
FIG. 5 is a side view of an exemplary embodiment of a modular multi-point lock system in a door with the first shootbolt assembly, second shootbolt assembly, and lock case illustrated in FIGS. 1-4.

Referring to FIG. 5, there is illustrated a side view of an exemplary embodiment of a modular multi-point lock system 100 installed in a door 150. A lock case 138 is disposed in a recess 158 and secured to a door edge 152 with appropriate fasteners, for example wood screws. Extending from the recess 158 are two additional recesses within the interior portion of the door 150. An upper recess 160 extends to and is in communication with the recess 158 and an opening in the upper portion 154 of the door. Another recess, the bottom recess 162, extends from the lower portion 156 of the door 150 and is in communication with the recess 158.

Each of the upper and bottom recesses, 160,162 are configured to receive the shootbolt assemblies 102,120 of the modular multi-point lock system 100. The recess 158 for the lock case 138 and each of the upper recess 160 and lower recess 162 for the respective shootbolt assemblies 102,120 can be machined into the door, for example by a router, mortise punch or drill press, or the recesses can be formed during a molding process to form the door. Each of the first shootbolt assembly 102 and the second shootbolt assembly 120 are coupled to the lock case 138 and configured to be extended or retracted by a locking mechanism in the lock case 138.

Figure 7:
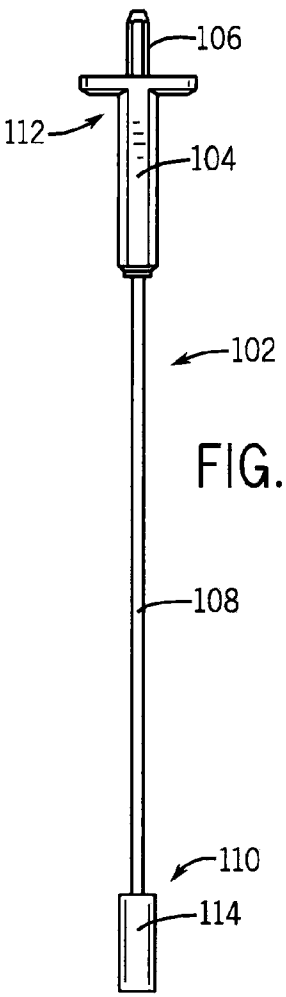
FIG. 7 is an illustration of the first shootbolt assembly shown in FIG. 6 rotated ninety degrees.
Figure 6:
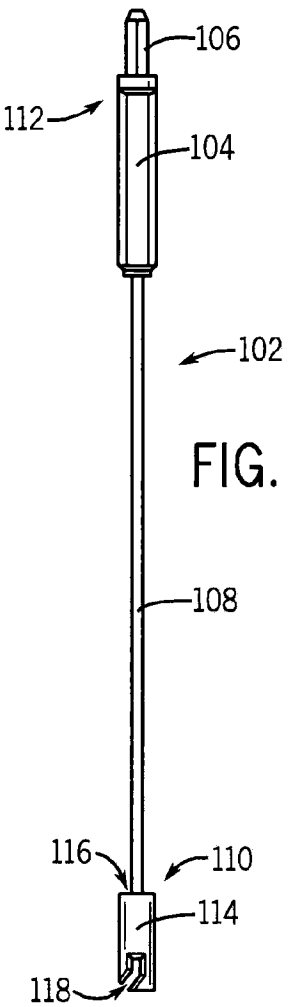
FIG. 6 is an illustration of the first shootbolt assembly shown in FIG. 5, with the shootbolt in an extended position.

FIGS. 6 and 7 illustrate an exemplary embodiment of a shootbolt assembly, specifically the first shootbolt assembly 102 of the modular multi-point lock system 100. FIG. 7 illustrates the shootbolt assembly 102 in the same orientation as illustrated in FIG. 5. FIG. 6 illustrates the first shootbolt assembly 102 rotated ninety degrees from the orientation of the shootbolt assembly in FIG. 7.

Each of the first shootbolt assembly 102 and the second shootbolt assembly 120 are substantially similar and therefore only one such shootbolt assembly will be described for this disclosure. A driverail 108 is an elongated rod which couples the shootbolt housing 104 and an engagement end housing 114. The driverail 108 (identical to second driverail 126) can be any cross-section deemed appropriate by the manufacturer or user of the modular multi-point lock system 100. For example, the driverail can have a circular cross-section, a polygon cross-section, such as a square or a rectangle. The driverail can be composed of material that is appropriate for its intended use, such as steel, engineered plastic or wood.

A shootbolt housing 104 is coupled to the distal end 112 of the shootbolt assembly. An engagement end housing 114 is coupled to a proximal end 110 of the shootbolt assembly. For purposes of this application, the proximal end of a shootbolt assembly is the end nearest the lock case 138, and the distal end of a shootbolt assembly is the end coupled to a shootbolt housing at the upper or lower portion of a door. The shootbolt housing 104 includes a shootbolt 106.

It should be understood that the term "shootbolt" as used herein in a multi-point lock is not a threaded fastener having a threaded portion and a head as is typically used for fastening components. As used herein, a "bolt" is a component of a multi-point lock that extends from a locking device installed in a top, bottom, and at sometimes lateral edge of a door or window to engage and secure the door or window into its frame or to other adjacent member, i.e. a French door unit.

It should also be understood that a bolt used in a multi-point lock may also be a shootbolt, tongue bolt, round bolt, roller bolt, swing bolt, and a hook bolt. Also, a multi-point lock system can also be configured with a number of shootbolts, for example three or four bolts in the multi-point lock system.

Figure 9:
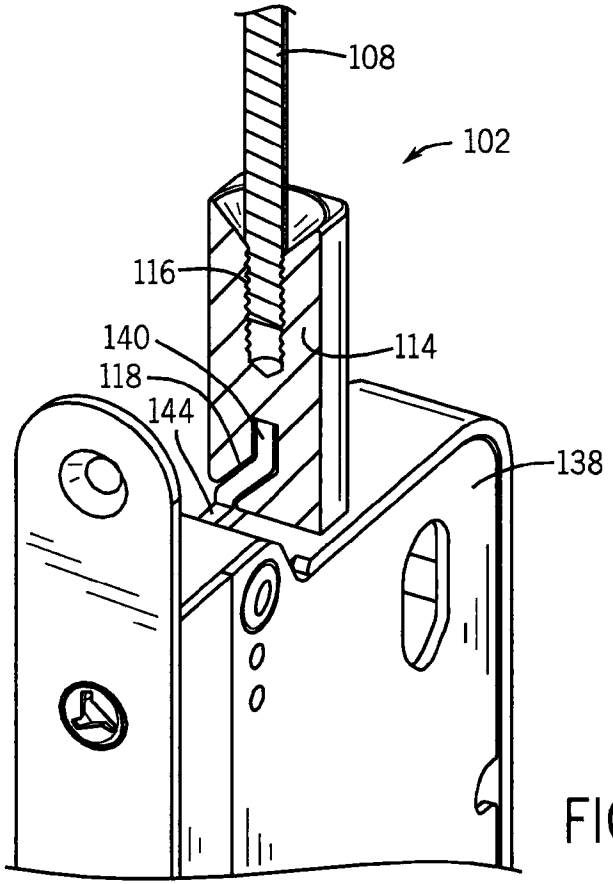
FIG. 9 is an enlarged isometric view of the lock cases illustrated in FIG. 4 and an enlarged isometric cross-section view of the engagement end housing coupled to the upper flange of the drive mechanism of the lock case with a drive rail threaded into the threaded portion of the engagement end housing.

The engagement end housing of a shootbolt assembly is more fully described with reference to FIGS. 8 and 9. The engagement end housing illustrated in FIGS. 8 and 9 or element 114 and is part of the first shootbolt assembly 102 illustrated in the figures. It should be understood that the engagement end housing 132 of the second shootbolt assembly 120 is identical other than its orientation being at the lower portion 156 of the door 150.

Figure 8:
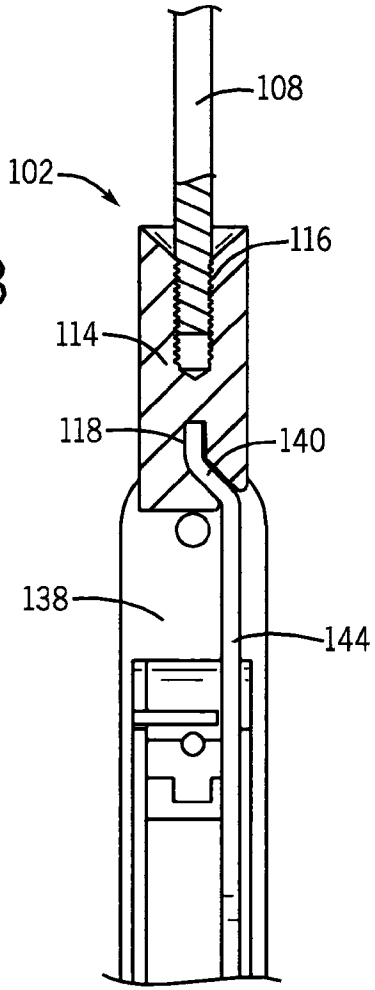
FIG. 8 is an enlarged cross-section rear view of the proximal end of the first shootbolt assembly coupled to the upper flange of the drive mechanism of the lock case of the modular multi-point lock system of FIG. 5.

Referring to FIG. 8, is a cross-section of the engagement end housing 114 and includes a slot 136 defined in one end of the engagement end housing 114. A threaded portion 116 is defined in another end of the engagement end housing 114. The threaded portion 116 includes a conical opening configured to guide a driverail 108 into the threaded portion 116 of the engagement end housing 114.

Figure 3:
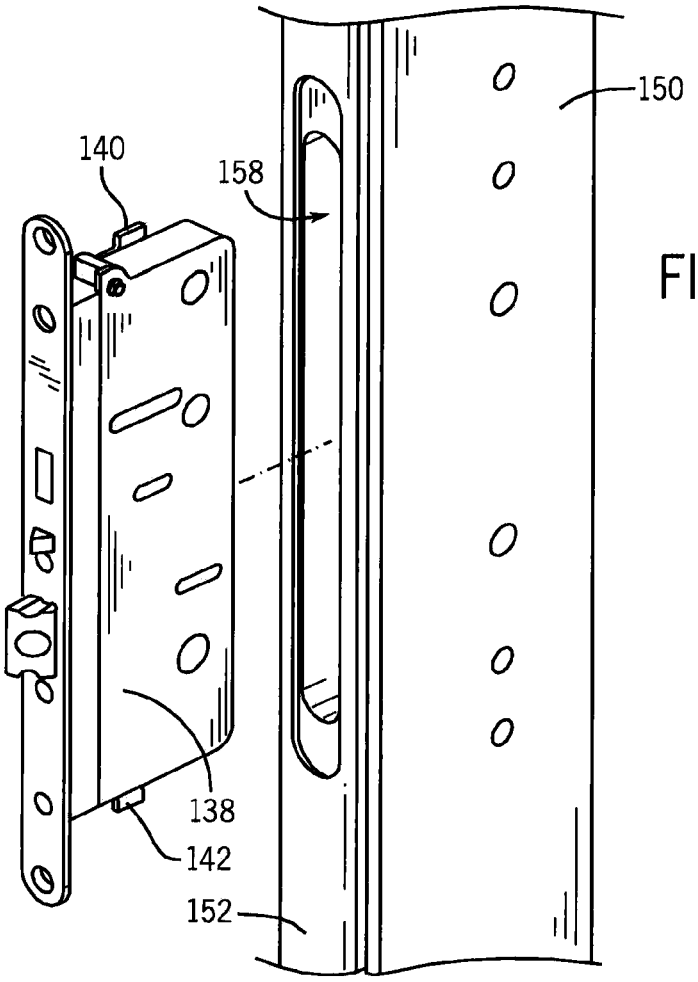
FIG. 3 is an isometric view illustrating the installation of a lock case into the edge of the door to engage the proximal ends of the first and second shootbolts for operation thereof, and showing drive arms respectively located on the top and bottom of the lock case for respectively engaging the proximal ends of the first and second shootbolts.
Figure 4:
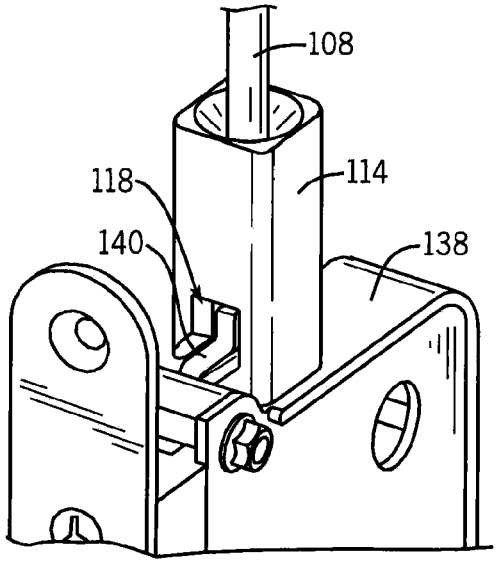
FIG. 4 is an enlarged isometric view of the upper portion of the lock case, the top drive arm, and the proximal end of the first shootbolt, showing the top drive arm engaged with the proximal end of the first shootbolt.

The slot 118 is configured to engage a flange 140,142 of a drive arm 144 in the lock case 138 without manual interconnection. The phrase "manual interconnection", means that a fastener or a tool is not used to couple the engagement end housing 114,132 to the flange 140,142 of the drive arm 144 of the first and second shootbolt assembly 102,120 of the modular multi-point lock system 100. As illustrated in FIG. 3, a lower flange 142, which is identical to the upper flange 140 also engages the shootbolt housing 122 of the second shootbolt assembly 120. The configuration of the slot 118 and the upper flange 140 couples the upper flange 140 in the slot 118 and maintains such engagement during a lock and unlock process of the lock case 138 to extend and retract the respective shootbolt 106,124 at the distal end 112,130 of each shootbolt assembly 102,120.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the modular multipoint lock system 100 of the present disclosure has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present disclosure. The particular embodiments and applications were chosen and described to provide the best illustration of the principles of the modular multi-point lock system 100 and its practical application to thereby enable one of ordinary skill in the art to utilize the system in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A modular multipoint lock for installation into a door having a lock case recess located in a side edge of a door, a top recess extending from a top edge of the door adjacent the side edge of the door to the lock case recess, and a bottom recess extending from a bottom edge of the door adjacent the side edge of the door to the lock case recess, the modular multipoint lock comprising:

a first shootbolt assembly configured to be mounted in the top recess of the door, the first shootbolt assembly having a first engagement end housing configured to be located in the lock case recess when the first shootbolt assembly is installed in the top recess and a first shootbolt housing and a first shootbolt configured to be located adjacent the top of the door when the first shootbolt assembly is installed in the top recess and the first shootbolt housing is fastened to the door, the first engagement end housing of the first shootbolt assembly including a first end defining a slot, the first engagement end housing being drivingly connected to the first shootbolt by a first driverail of the first shootbolt assembly, the first drive rail being fixedly attached to the first engagement end housing;

a second shootbolt assembly configured to be mounted in the bottom recess, the second shootbolt assembly having a second engagement end housing configured to be located in the lock case recess when the second shootbolt assembly is installed in the bottom recess and a second shootbolt housing and a second shootbolt configured to be located adjacent the bottom of the door when the second shootbolt assembly is installed in the bottom recess and the second shootbolt housing is fastened to the door, the second engagement end housing of the second shootbolt assembly including a first end defining a slot, the first engagement end housing being drivingly connected to the second shootbolt by a second driverail of the second shootbolt assembly, the second drive rail being fixedly attached to the second engagement end housing; a lock case having first and second drive arms extending therefrom, the first drive arm configured to extend into the slot defined in the first end of the first engagement end housing of the first shootbolt assembly to drivingly couple the first drive arm to the first engagement end housing and the second drive arm configured to extend into the slot defined in the first end of the second engagement end housing of the second shootbolt assembly to drivingly couple the second drive arm to the second engagement end housing when the lock case is inserted into the lock case recess, and the first and second drive arms configured to respectively disengage from the first and second engagement end housings of the first and second shootbolt assemblies when the lock case is removed from the lock case recess;

wherein the first drive arm is configured to slidingly engage into the slot defined in the first end of the first engagement end housing and the second drive arm is configured to slidingly engage into the slot defined in the first end of the second engagement end housing when the lock case is inserted into the lock case recess merely by the act of inserting the lock case into the lock case recess, and the first and second drive arms are configured to respectively slidingly disengage from the first and second engagement end housings of the first and second shootbolt assemblies when the lock case is removed from the lock case recess merely by the act of removing the lock case from the lock case recess.

2. The modular multi-point lock of claim 1, wherein the first engagement end housing includes a second end opposite the first end, the second end including a threaded portion; and wherein the second engagement end housing includes a second end opposite the first end, the second end including a threaded portion.

3. The modular multi-point lock of claim 2, with the threaded portion including a conical opening configured to guide a driverail into the threaded portion of each of the engagement end housings.

4. The modular multi-point lock of claim 2, wherein the first drive arm is drivingly coupled to the first engagement end housing without use of a fastener to couple the first engagement end housing to the first drive arm.

5. The modular multi-point lock of claim 4, with each drive arm configured to remain in its respective slot engaged with its respective engagement end housing during a lock and unlock process of the lock case to extend and retract the respective shootbolt at the distal end of each shootbolt assembly.

6. The modular multi-point lock of claim 1, wherein the first engagement end housing is configured to reciprocally move to extend and retract the first shootbolt.

7. The modular multi-point lock of claim 1, wherein the first shootbolt housing is configured to be fastened to the door and wherein the first shootbolt is movable relative to the first shootbolt housing.

8. A method of installing a modular multi-point lock system in a door, with the door defining a lock case recess located in a side edge of the door, a top recess extending from a top edge of the door adjacent the side edge of the door to the lock case recess, and a bottom recess extending from a bottom edge of the door adjacent the side edge of the door to the lock case recess, the method comprising:

installing a lock case in the lock case recess, the lock case including a upper and lower drive arm flange extending therefrom;

installing a first shootbolt assembly in the top recess, the first shootbolt assembly including a shootbolt and a first engagement end housing fixedly attached to a first drive rail with the first engagement end housing defining a slot configured to slidingly engage the upper drive arm flange, wherein such installation drivingly connects the first shootbolt assembly to the lock case; and installing a second shootbolt assembly in the bottom recess, the second shootbolt assembly including a shootbolt and a second engagement end housing coupled to a second drive rail with the second engagement end housing defining a slot configured to slidingly engage the lower drive arm flange, wherein such installation drivingly connects the second shootbolt assembly to the lock case.

9. The method of installing a modular multi-point lock system in a door of claim 8, including threadingly coupling each drive rail to a threaded portion defined in each engagement end housing.

10. The method of installing a modular multi-point lock system in a door of claim 9, including guiding the drive rail into the threaded portion of the engagement end housing with a conical opening defined in one end of the engagement end housing.

11. The method of installing a modular multi-point lock system in a door claim 8 wherein the installation of each of the first and second shootbolt assemblies coupling each such assembly to the lock case in done without manual interconnection.

12. The method of installing a modular multi-point lock system in a door of claim 8, with the slot defined in each engagement end housing configured to remain engaged with the respective upper and lower flange during a lock and unlock process of the lock case to extend and retract the respective shootbolt at the distal end of each shootbolt assembly.

13. The method of installing a modular multi-point lock system in a door of claim 8, wherein the first drive arm is brought into driving engagement with the slot defined in the first end of the first engagement end housing and the second drive arm is brought into driving engagement with the slot defined in the first end of the second engagement end housing when the lock case is inserted into the lock case recess merely by the act of inserting the lock case into the lock case recess.

14. A modular multipoint lock for installation into a door having a lock case recess located in a side edge of a door, a top recess extending from a top edge of the door adjacent the side edge of the door to the lock case recess, and a bottom recess extending from a bottom edge of the door adjacent the side edge of the door to the lock case recess, the modular multipoint lock comprising:

a first shootbolt assembly configured to be mounted in the top recess, the first shootbolt assembly having a first engagement end housing configured to be located in the lock case recess when the first shootbolt assembly is installed in the top recess and a first shootbolt housing and a first shootbolt located adjacent the top of the door when the first shootbolt assembly is installed in the top recess and the first shootbolt housing is fastened to the door, the first engagement end housing of the first shootbolt assembly being drivingly connected to the first shootbolt by a first driverail of the first shootbolt assembly, the first drive rail being fixedly attached to the first engagement end housing;

a second shootbolt assembly for mounting in the bottom recess, the second shootbolt assembly having a second engagement end housing that will be located in the lock recess when the second shootbolt assembly is installed in the bottom recess and a second shootbolt housing and a second shootbolt located adjacent the bottom of the door when the second shootbolt assembly is installed in the bottom recess and the second shootbolt housing is fastened to the door, the second engagement end housing of the second shootbolt assembly being drivingly connected to the second shootbolt, the second drive rail being fixedly attached to the second engagement end housing;

a lock case having first and second drive arms extending therefrom with each drive arm including a flange extending from the lock case, the first and second drive arms respectively engaging a slot defined in each of the first and second engagement end housings of the first and second shootbolt assemblies when the lock case is inserted into the lock case recess, and the first and second drive arms respectively disengaging from the slot the first and second engagement end housings of the first and second shootbolt assemblies when the lock case is removed from the lock case recess;

wherein the first drive arm is configured to slidingly engage into the slot defined in the first end of the first engagement end housing and the second drive arm is configured to slidingly engage into the slot defined in the first end of the second engagement end housing when the lock case is inserted into the lock case recess merely by the act of inserting the lock case into the lock case recess, and the first and second drive arms configured to respectively slidingly disengage from the first and second engagement end housings of the first and second shootbolt assemblies when the lock case is removed from the lock case recess merely by the act of removing the lock case from the lock case recess.

15. The modular multi-point lock of claim 14, wherein the slot is defined in one end and a threaded portion in another end of each of the first and second engagement end housings.

16. The modular multi-point lock of claim 15, with the threaded portion including a conical opening configured to guide a driverail into the threaded portion of each of the engagement end housings, with the driverail coupling the shootbolt housing and engagement end housing of each shootbolt assembly in a unit.

17. The modular multi-point lock of claim 14, with the slot defined in each engagement end housing configured to remain engaged with the flange during a lock and unlock process of the lock case to extend and retract the respective shootbolt at the distal end of each shootbolt assembly.

* * * * *